US011713568B2

(12) United States Patent
Bregman

(10) Patent No.: US 11,713,568 B2
(45) **Date of Patent: *Aug. 1, 2023**

(54) THROUGH-FLOOR COMBINATION TUB AND SURFACE DRAIN

(71) Applicant: Warren Bregman, Woodland Hills, CA (US)

(72) Inventor: Warren Bregman, Woodland Hills, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/553,383

(22) Filed: Dec. 16, 2021

(65) Prior Publication Data

US 2022/0341149 A1 Oct. 27, 2022

Related U.S. Application Data

(63) Continuation of application No. 17/239,547, filed on Apr. 24, 2021, now Pat. No. 11,203,861.

(51) Int. Cl.
*E03F 5/04* (2006.01)
*E03C 1/22* (2006.01)

(52) U.S. Cl.
CPC ..... *E03F 5/0409* (2013.01); *E03C 1/22* (2013.01); *E03F 5/0407* (2013.01)

(58) Field of Classification Search
CPC ..... E03F 5/0407; E03F 5/0409; E03F 5/042; E03C 1/22; E03C 2001/22
USPC ..... 210/163, 164, 165; 4/679, 293; 52/302.1, 302.7
See application file for complete search history.

(56) References Cited

U.S. PATENT DOCUMENTS

| | | | |
|---|---|---|---|
| 2,362,250 | A | 11/1944 | Max |
| 4,045,346 | A | 8/1977 | Swaskey |
| 5,117,597 | A | 6/1992 | Feller |
| 5,724,777 | A | 3/1998 | Hubbard |
| 9,322,157 | B1 | 4/2016 | Ismert |
| 9,551,138 | B2 | 1/2017 | McLeod et al. |

(Continued)

FOREIGN PATENT DOCUMENTS

| | | | |
|---|---|---|---|
| EP | 0494060 | A1 | 7/1992 |
| GB | 2488773 | A | 9/2012 |

(Continued)

OTHER PUBLICATIONS

Oakville Stamping & Bending, Model ITD35 ABS Island Tub Drain™ Testable Rough-in for Freestanding Tubs, 2017, available at https://web.archive.org/web/20170712162650/https://osb.ca/products/tub-shower-WC/tub/freestanding-tub-drains/tub-ITD35.php.

(Continued)

*Primary Examiner* — Christopher Upton
(74) *Attorney, Agent, or Firm* — Huse IP Law; Charles C. Huse

(57) ABSTRACT

A through-floor combination tub and surface drain includes an exterior tube having a top end and a bottom end. The bottom end of the exterior tube is to connect to a sewer pipe. The top end of the exterior tube has one or more openings to provide a floor drain. The drain also includes an interior tube situated within the exterior tube. The interior tube has a top end to receive a drain pipe and a bottom end that opens into a cavity within the exterior tube that extends from the top end of the exterior tube to the bottom end of the exterior tube. The drain further includes a flange, extending outward radially from the exterior tube, to connect to a substrate of a floor.

18 Claims, 8 Drawing Sheets

(56) References Cited

U.S. PATENT DOCUMENTS

| | | | | |
|---|---|---|---|---|
| 11,203,861 | B1 * | 12/2021 | Bregman | E03F 5/0407 |
| 2010/0089838 | A1 | 4/2010 | Söderström | |
| 2019/0257061 | A1 | 8/2019 | Frink et al. | |

FOREIGN PATENT DOCUMENTS

| | | | |
|---|---|---|---|
| KR | 20180118453 | A | 10/2018 |
| WO | 0206595 | A1 | 1/2002 |

OTHER PUBLICATIONS

Oakville Stamping & Bending, Model ITD5135 PVC Island Tub Drain™ Testable Rough-in for Freestanding Tubs, 2017, available at https://web.archive.org/web/20170712140856/https://osb.ca/products/tub-shower-WC/tub/freestanding-tub-drains/ITD5135.php.

PCT/US2022/026068, International Search Report, dated Aug. 11, 2022.

PCT/US2022/026068, Written Opinion of the International Searching Authority, dated Aug. 11, 2022.

* cited by examiner

THROUGH-FLOOR COMBINATION TUB AND SURFACE DRAIN

RELATED APPLICATION

This application is a continuation of U.S. patent application Ser. No. 17/239,547, filed on Apr. 24, 2021, which is incorporated by reference in its entirety.

TECHNICAL FIELD

This disclosure relates to plumbing fixtures, and more specifically to drains.

BACKGROUND

Installing a bathtub traditionally involves slotting the bathtub's drain pipe into a PVC (i.e., polyvinyl chloride) pipe that leads to the sewer (i.e., slotting the drain pipe into a PVC sewer pipe). Such an installation, however, does not allow water that splashes out of the bathtub onto the floor to drain. For example, if the bathtub is a free-standing bathtub, such an installation allows water to pool around the outside of the drain pipe without being able to drain.

Adapters have been developed for connecting the drain pipe of a free-standing bathtub. Such adapters, which may be referred to as rough-in kits, have been found to fail frequently, however. For example, popular adapters include a serrated rubber component that fails frequently, requiring contractors to perform rework.

SUMMARY

According, there is a need for improved adapters for connecting the drain pipe of a bathtub (e.g., free-standing bathtub) to a sewer pipe.

In some embodiments, a drain includes an exterior tube having a top end and a bottom end. The bottom end of the exterior tube is to connect to a sewer pipe. The top end of the exterior tube has one or more openings to provide a floor drain. The drain also includes an interior tube situated within the exterior tube. The interior tube has a top end to receive a drain pipe and a bottom end that opens into a cavity within the exterior tube that extends from the top end of the exterior tube to the bottom end of the exterior tube. The drain further includes a flange, extending outward radially from the exterior tube, to connect to a substrate of a floor.

In some embodiments, a drain-installation method includes providing a drain with an exterior tube having a top end and a bottom end, an interior tube situated within the exterior tube and having a top end and a bottom end, and a flange extending outward radially from the exterior tube. The bottom end of the interior tube opens into a cavity within the exterior tube that extends from the top end of the exterior tube to the bottom end of the exterior tube. The method also includes connecting the bottom end of the exterior tube to a sewer pipe, connecting the flange to a substrate of a floor, and inserting a drain pipe into the top end of the interior tube.

BRIEF DESCRIPTION OF THE DRAWINGS

For a better understanding of the various described implementations, reference should be made to the Detailed Description below, in conjunction with the following drawings.

Like reference numerals refer to corresponding parts throughout the drawings and specification.

DETAILED DESCRIPTION

Reference will now be made in detail to various embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

Figure 1A:
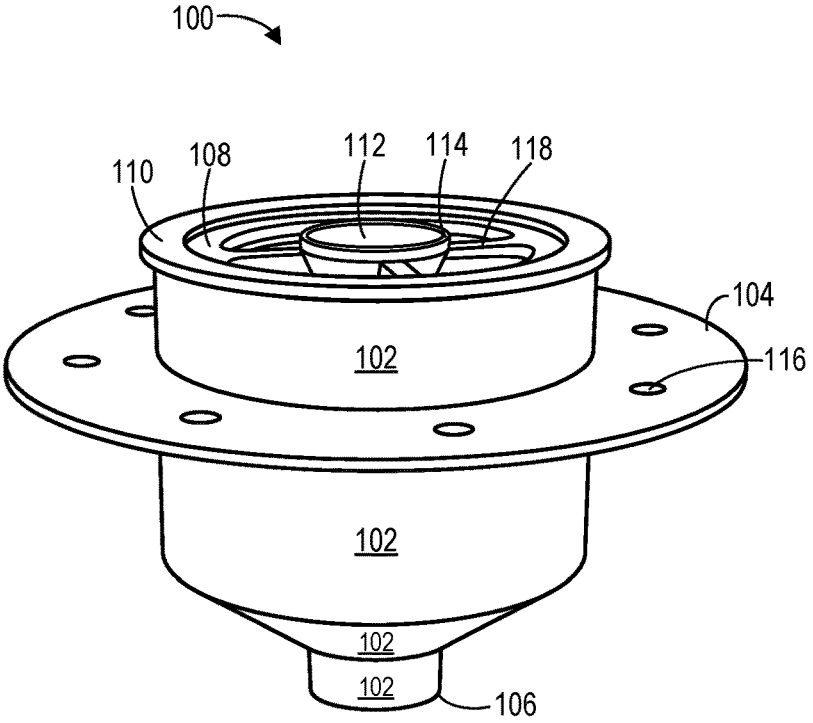
FIGS. 1A-1E show a through-floor combination tub and surface drain in accordance with some embodiments.
Figure 1B:
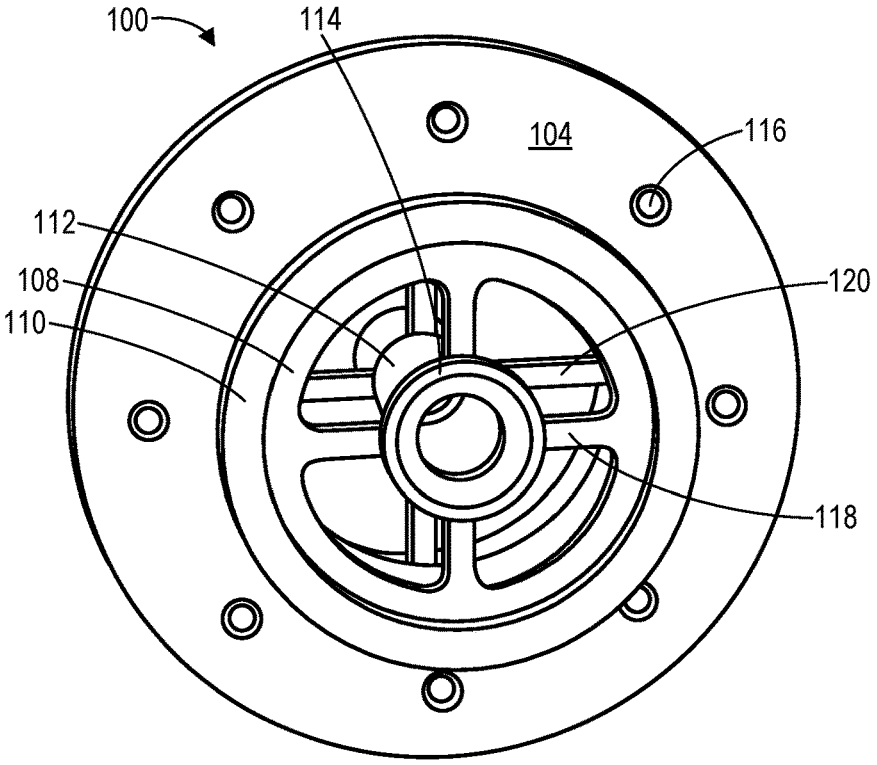
Figure 1C:
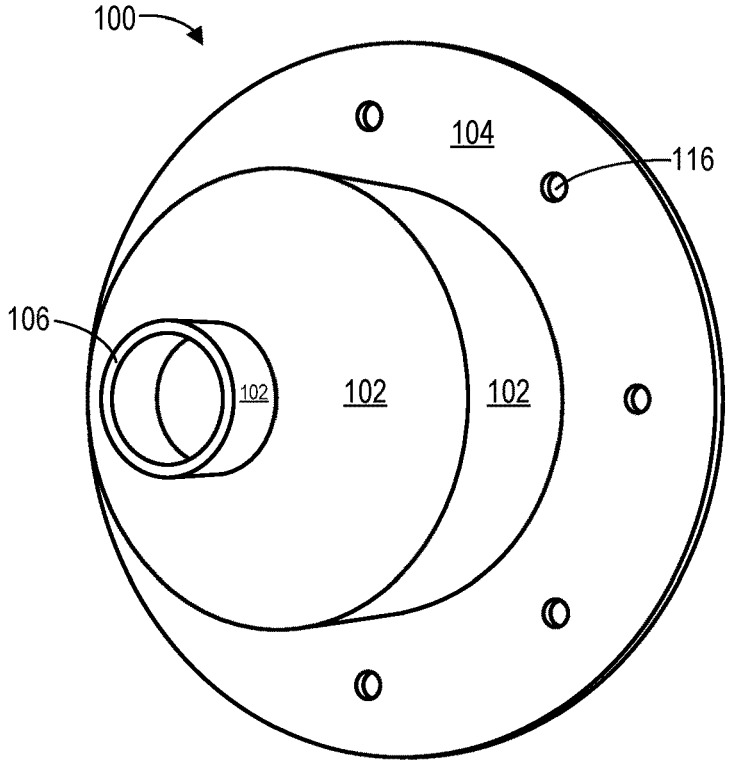
Figure 1D:
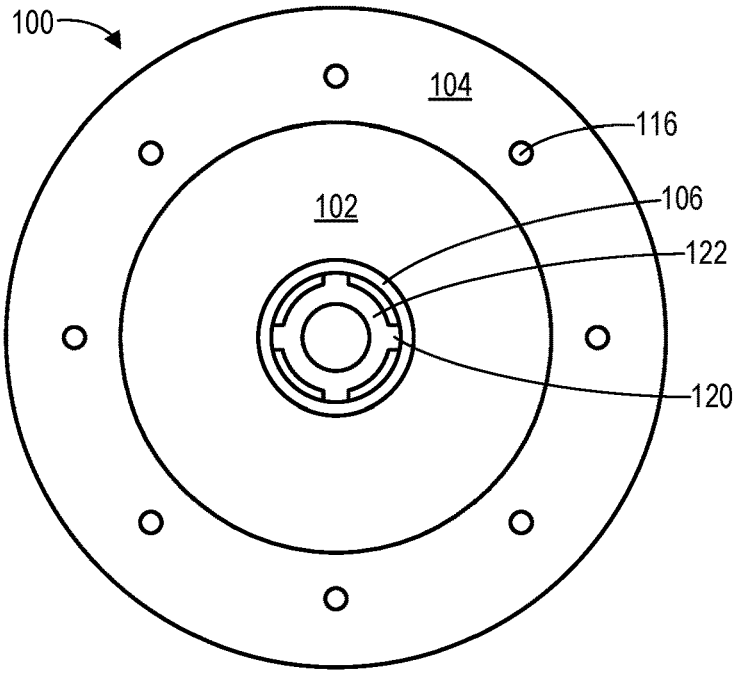
Figure 1E:
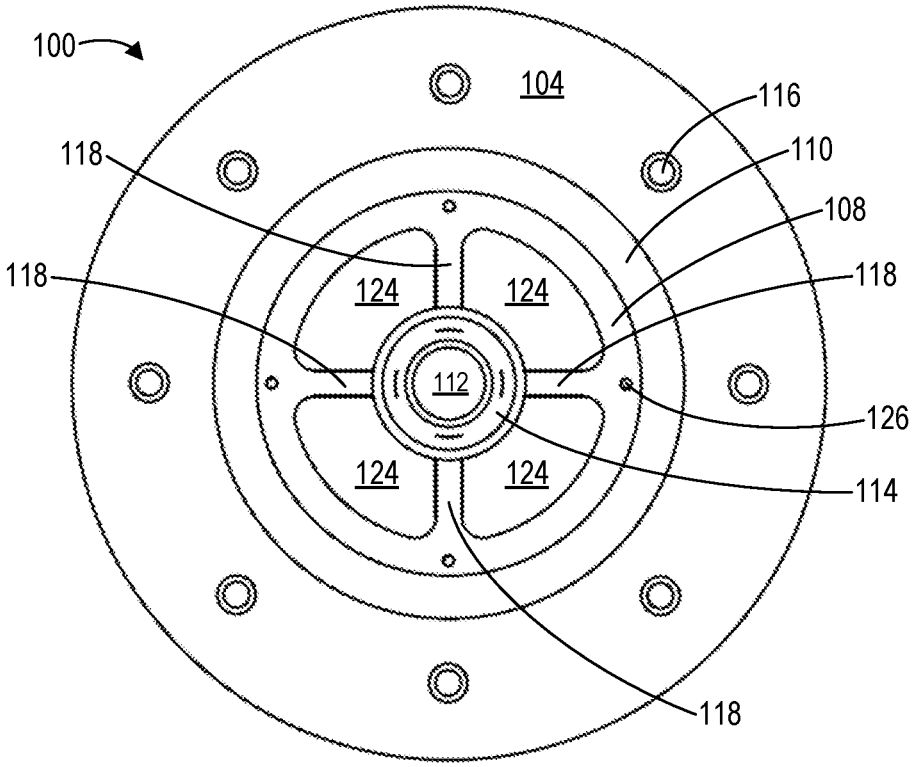

FIGS. 1A-1E show a through-floor combination tub and surface drain 100 in accordance with some embodiments. FIG. 1A is a perspective view of the side of the drain 100, FIG. 1B is a perspective view of the top of the drain 100, FIG. 1C is a perspective view of the bottom of the drain 100, FIG. 1D is a bottom view of the drain 100, and FIG. 1E is a plan view (i.e., top view) of the drain 100. The drain 100 is used to install a bathtub (e.g., a free-standing bathtub) or similar plumbing fixture. The drain 100 includes an exterior tube 102, an interior tube 112, and a flange 104. The interior tube 112 is situated within the exterior tube 102, such that the interior tube 112 and exterior tube 102 are nested. For example, the interior tube 112 and the exterior tube 102 are coaxial (i.e., cross-sections of the interior tube 112 and exterior tube 102 are concentric).

The exterior tube 102 has a top end 108 and a bottom end 106. The top end 108 may include a flange 110, which forms a lip at the top end 108 of the exterior tube 102. Once the drain 100 has been installed through a floor, the floor may be finished such that it finishes into the flange 110. For example, floor tiling may finish into the flange 110. The bottom end 106 connects to a sewer pipe. The sewer pipe may lead directly or indirectly to a sewer line or to another destination for wastewater (e.g., to a gray-water recycling system). The interior tube 112 has a top end 114 and a bottom end 122 (FIG. 1D). The top end 114 receives a drain pipe from the bathtub (i.e., the drain pipe slots into the top end 114 of the interior tube 112). The bottom end 122 opens into a cavity (e.g., cavity 402, FIG. 4) within the exterior tube 102. This cavity extends from the top end 108 of the exterior tube 102 to the bottom end 106 of the exterior tube 102. The cavity includes a first portion that is inside the exterior tube 102 but outside the interior tube 112 and a second portion into which the interior tube 112 does not extend. Wastewater on the floor flows into the top end 108 of the exterior tube 102, through the cavity, and out the bottom end 106 of the exterior tube 102 into the sewer pipe. Wastewater from the bathtub flows out through the drain pipe, the interior tube 112, and the cavity of the exterior tube 102 and out the bottom end 106 of the exterior tube 102 into the sewer pipe.

In some embodiments, the drain 100 includes a plurality of struts that extends from the inner surface of the exterior tube 102 to the outer surface of the interior tube 112 to hold the interior tube 112 within the exterior tube 102. The struts thus extend across the first portion of the cavity within the exterior tube 102 to connect the exterior tube 102 to the interior tube 112. The struts include, for example, a first set of struts 118 at the top ends 114 and 108 of the interior and exterior tubes 112 and 102 and a second set of struts 120 at the bottom end 122 of the interior tube 112. The first set of struts 118 extend from the inner surface of the top end 108 of the exterior tube 102 to the outer surface of the top end 114 of the outer surface of the interior tube 112. The first set of struts 118 divides the opening at the top end 108 of the exterior tube 102 into a plurality of openings 124 (FIG. 1E), through which wastewater can drain into the cavity of the exterior tube 102. (In general, the top end 108 of the exterior tube 102 may have one or more openings that provide a floor drain.) Respective openings 124 of the plurality of openings 124 are thus separated by respective struts 118 of the first set of struts 118. The second set of struts 120 extend from an intermediate point on the inner surface of the exterior tube 102 to the outer surface of the bottom end 122 of the outer surface of the interior tube 112. Alternatively, or in addition, one or more sets of struts may connect the exterior tube 102 to the interior tube 112 at one or more other positions along the tubes. While the first set of struts 118 and the second set of struts 120 are each shown as having four struts, the number of struts in each set may vary, as may the number of sets of struts.

In some embodiments, the top end 114 of the interior tube 112 has a beveled inner surface that allows the interior tube 112 to receive the drain pipe at a tilt (i.e., the drain pipe may be inserted into the interior tube 112 at a tilt). For example, the top end 114 of the interior tube 112 includes a flange that has a beveled inner surface (e.g., as shown in FIG. 1B) to receive the drain pipe at a tilt. By easing insertion (i.e., slotting) of the drain pipe into the inner tube 112, the beveled surface eases installation of the corresponding bathtub.

The flange 104 extends outward radially from the exterior tube 102 (e.g., such that the flange 104 surrounds the exterior tube 102 at a particular position along the exterior tube 102 and connects to the outer surface of the exterior tube 102 at that position). The flange 104 can be connected to a substrate (e.g., a plywood or concrete substrate) of a floor (e.g., the floor beneath the bathtub), thus connecting the drain 100 to the floor. The flange 104 may include holes 116 used to connect the flange 104 to the floor (e.g., by screwing or bolting the flange 104 to the floor).

In some embodiments, the top end 114 of the interior tube 112 and the top end 108 of the exterior tube 102 are substantially coplanar (e.g., to within manufacturing tolerances). For example, a flange at the top end 114 of the interior tube 112 is substantially coplanar with the flange 110 at the top end 108 of the exterior tube 102. In some embodiments, the interior tube 112 may extend beyond the top end 108 of the exterior tube 102 (e.g., beyond the flange 110), such that the top end 114 of the interior tube 112 is above the top end 108 of the exterior tube 102 (e.g., is above the flange 110).

In some embodiments, the drain 100 is a unitary piece of plastic (e.g., a piece of molded plastic or a piece of plastic manufactured using additive manufacturing). For example, the exterior tube 102, the interior tube 112, the flange 104, and the struts 118 and/or 120 compose a unitary piece of plastic (e.g., a single piece of plastic from a single mold or a single piece of plastic manufactured using additive manufacturing). In some other embodiments, the drain 100 is a unitary piece of plastic (e.g., a single piece of plastic from a single mold or a single piece of plastic manufactured using additive manufacturing) except for the flange 104, which is connected (e.g., glued) to the unitary piece of plastic. For example, the exterior tube 102, the interior tube 112, and the struts 118 and/or 120 compose a unitary piece of plastic, and the flange 104 is a piece of metal (e.g., aluminum) connected (e.g., glued) to the unitary piece of plastic.

Figure 2A:
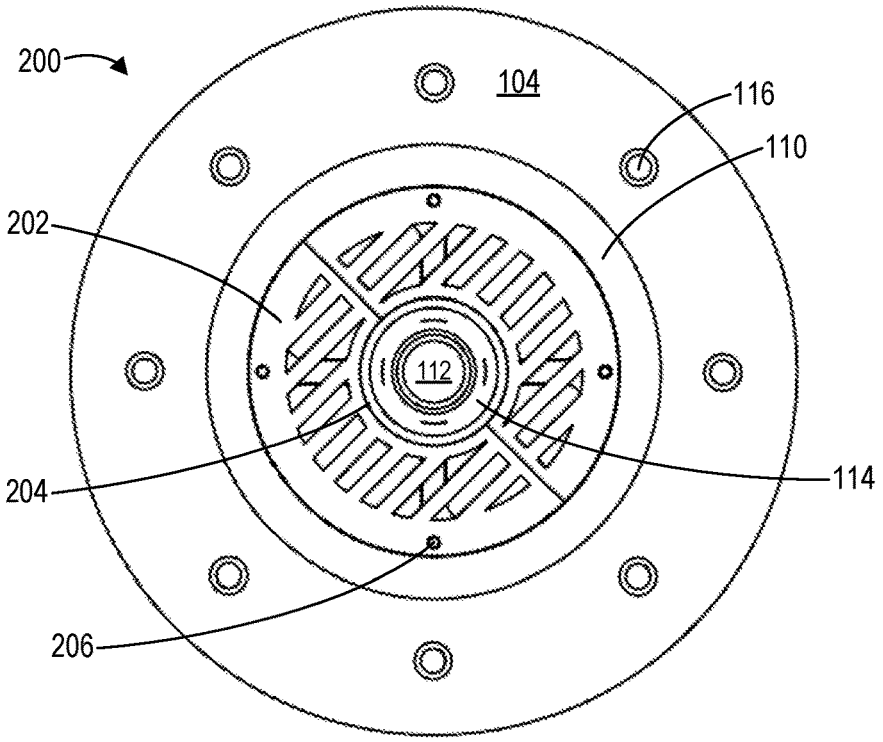
FIGS. 2A and 2B are plan views of examples of the drain of FIG. 1 with a grate covering the top end of the exterior tube of the drain, in accordance with some embodiments.

FIG. 2A is a plan view of a drain 200 in accordance with some embodiments. The drain 200 is an example of the drain 100 (FIGS. 1A-1E) with a grate 202 covering the top end 108 of the exterior tube 102. The grate 202 has a central aperture 204 to allow the interior tube 112 to receive the drain pipe. For example, the aperture 204 is circular with a diameter equal to or greater than the outer diameter of the inner tube 112. The drain pipe can be inserted through the aperture 204 into the top end 114 of the inner tube 112. The grate 202 allows wastewater on the floor to flow into the exterior tube 102 while blocking sufficiently large objects from falling into the exterior tube 102. The grate 202 may be connected to (e.g., screwed into) the exterior tube 102 using holes 206 in the grate 202 and corresponding holes 126 (FIG. 1E) in the top end 108 of the exterior tube 102. In some embodiments, the grate 202 is seated within (i.e., surrounded radially by) the flange 110 of the top end 108 of the exterior tube 102.

Figure 2B:
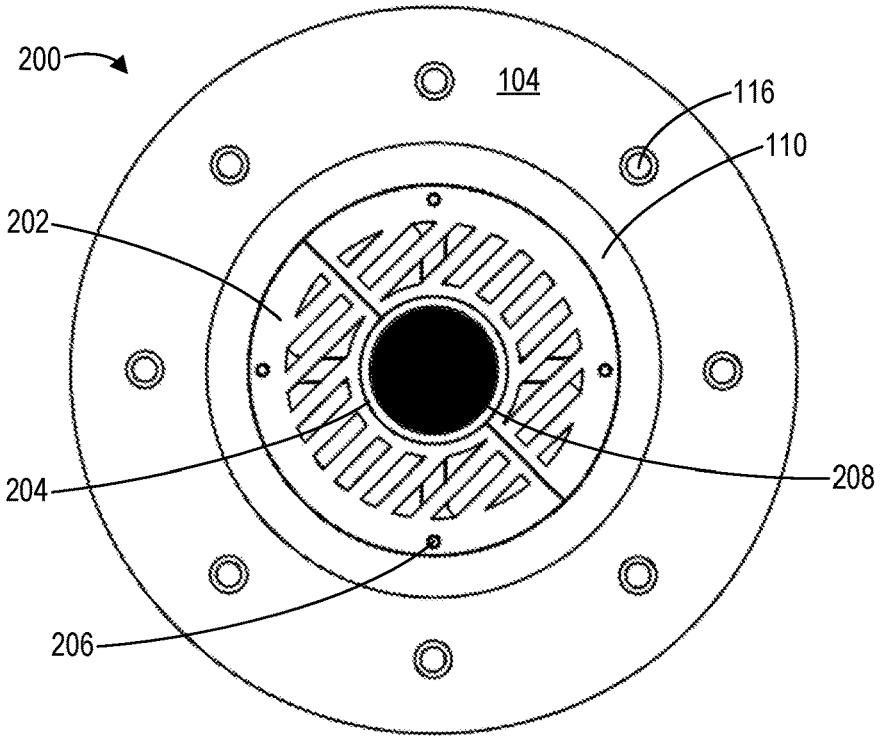

In some embodiments, the drain 200 may be used in the absence of a drain pipe (e.g., in the absence of a bathtub). For example, the drain 200 may be used as a surface drain (e.g., floor drain). A solid piece (e.g., disc) 208 may cover the aperture 204 (or a portion thereof) and thus cover the top end of the interior tube 112, as shown in FIG. 2B. Alternatively, the grate 202 is replaced with a grate that does not have a central aperture 204 and that covers the top end of the interior tube 112 as well as the top end 108 of the exterior tube 102.

Figure 3:
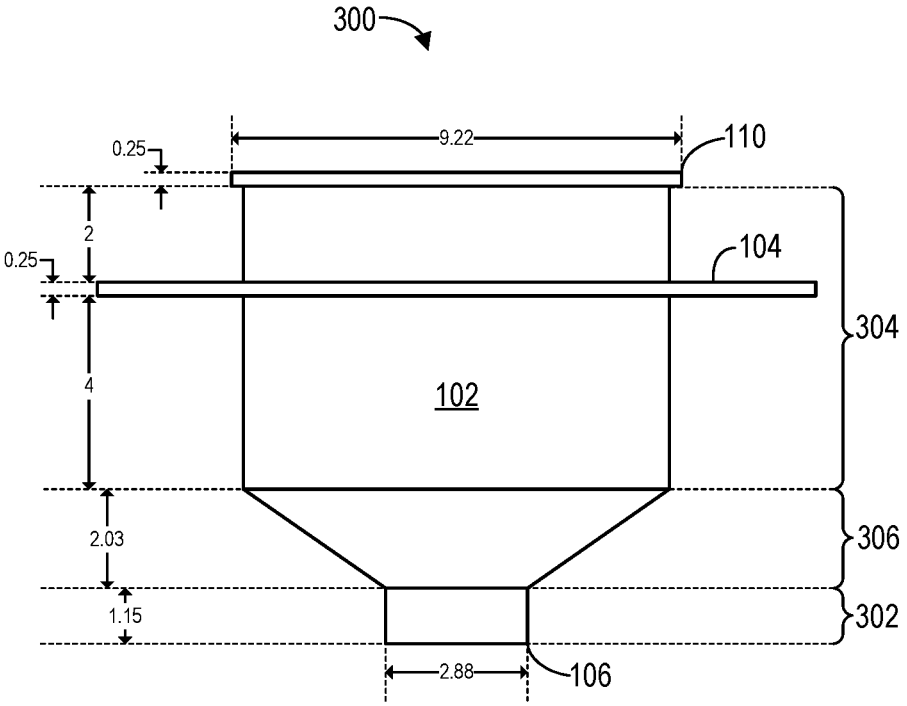
FIG. 3 is a side view of the drain of FIG. 1 with examples of dimensions, in accordance with some embodiments.

FIG. 3 is a side view of a drain 300 in accordance with some embodiments. The drain 300 is an example of the drain 100 (FIGS. 1A-1E). The exterior tube 102 of the drain 300 includes a first portion 302, a second portion 304, and a third portion 306. The first portion 302, which includes the bottom end 106 of the exterior tube 102, has a first outer diameter. The second portion 304, from which the flange 104 extends outward radially, has a second outer diameter that is greater than the first outer diameter. The third portion 306, which is situated between the first portion 302 and the second portion 304, has an outer diameter that transitions smoothly from the first outer diameter to the second outer diameter. In some embodiments, the second portion 304 extends from the flange 110 of the top end 108 of the exterior tube 102 to the third portion 306. In some embodiments, the third portion 306 transitions at a slant from the first portion 302 to the second portion 304. Alternatively, the third portion 306 transitions in a substantially smooth curve (in cross-section) from the first portion 302 to the second portion 304.

FIG. 3 shows examples of dimensions for the drain 300. In the example of FIG. 3, the flange 104 and the flange 110 each have a width of 0.25 in. The flange 110 of the top end 108 of the exterior tube 102 has an outer diameter of 9.22 in.

The bottom end 106 of the exterior tube 102 has an outer diameter of 2.88 in. The distance from the flange 104 to the flange 110 is 2 in. The distance from the flange 104 to the bottom of the second portion 304 is 4 in. The depth of the first portion 302 is 1.15 in. The depth of the third portion 306 is 2.03 in.

In another example, the flange 104 and the flange 110 each have a width of 0.125 in. The distance from the flange 104 to the flange 110 is 2 in. The distance from the flange 104 to the bottom of the second portion 304 is 1.5 in. The depth of the first portion 302 is 1.5 in. The depth of the third portion 306 is 0.5 in. These are merely two examples of dimensions. Still other dimensions are possible.

Figure 4:
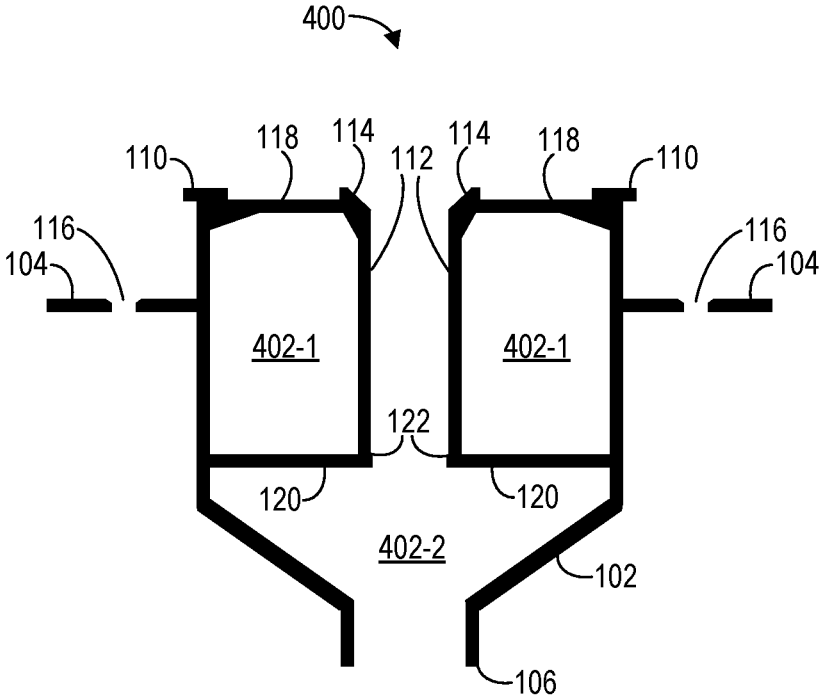
FIG. 4 is a cross-sectional side view of the drain of FIG. 1 in accordance with some embodiments.

FIG. 4 is a cross-sectional side view of a drain 400 in accordance with some embodiments. The drain 400 is an example of the drain 100 (FIGS. 1A-1E). A cavity 402 extends through the exterior tube 102 to allow wastewater to drain through the exterior tube 102. The cavity 402 includes a first portion 402-1 that is inside the exterior tube 102 but outside the interior tube 112 and a second portion 402-2 into which the interior tube 112 does not extend. The bottom end 122 of the interior tube 112 empties into the cavity 402 (i.e., into the second portion 402-2). Wastewater from the bathtub thus may drain from the drain pipe through the interior tube 112 into and through the cavity 402. In some embodiments, the bottom end 122 of the interior tube 112 is situated within the second portion 304 (FIG. 3) of the exterior tube 102.

Figure 5:
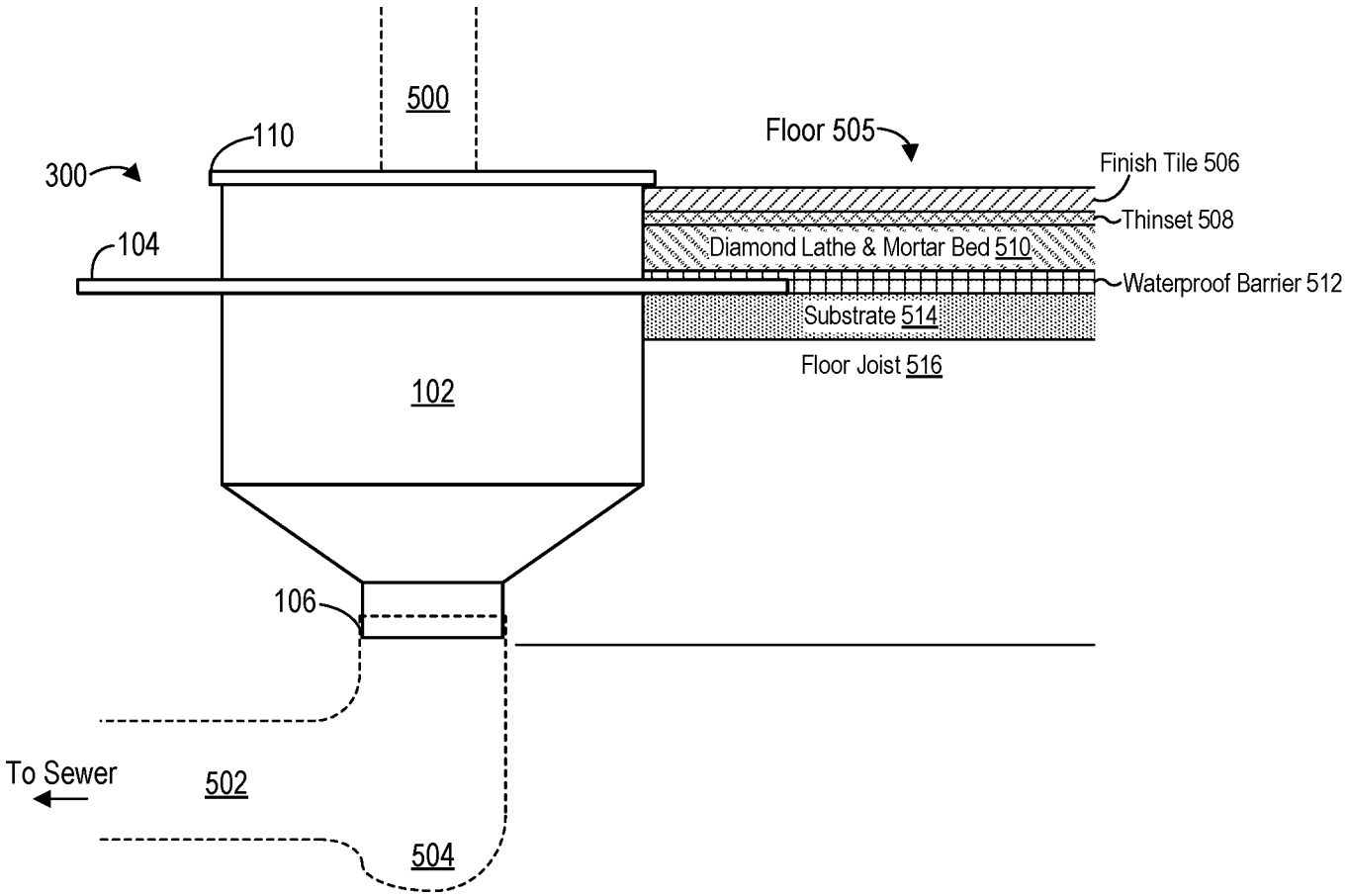
FIG. 5 shows the drain of FIG. 3 as installed in a floor to serve as an adapter between a drain pipe and a sewer pipe, in accordance with some embodiments.

FIG. 5 shows the drain 300 (FIG. 3) as installed in a floor 505 to serve as an adapter between a drain pipe 500 and a sewer pipe 502, in accordance with some embodiments. The drain pipe 500 has been inserted into the interior tube 112 (which is not visible in the side view of FIG. 5). The sewer pipe 502, which is connected to the bottom end 106 of the exterior tube 102, includes a trap 504 into which the exterior tube 102 empties (e.g., the cavity 402, FIG. 4, empties into the trap 504). The sewer pipe 502 leads directly or indirectly to a sewer line or to another destination for wastewater (e.g., to a gray-water recycling system).

The flange 104 is connected (e.g., using holes 116) to a substrate 514 of the floor 505. In some embodiments, the substrate 514 is either plywood or concrete. The substrate 514 is on a floor joist 516. The sewer pipe 502 is beneath the floor joist 516. Once the flange 104 has been connected to the substrate 514, the substrate 514 and the flange 104 are covered with a waterproof barrier 512. A diamond lathe and mortar bed 510 covers the waterproof barrier 512. A thinset 508 covers the diamond lathe and mortar bed 510. Finish tiles 506 are installed on the thinset 508. The finish tiles 506 may finish into the flange 110, such that one or more respective finish tiles 506 contact the flange 110. Wastewater on the surface of the finish tiles 506 may run off into the exterior tube 102 and down into the sewer pipe 502. Wastewater in the bathtub (not shown) runs through the drain pipe 502, the interior tube 112, and a lower portion of the exterior tube 102 into the sewer pipe 502. The drain 300 thus acts as a through-floor combination tub and surface drain.

Figure 6:
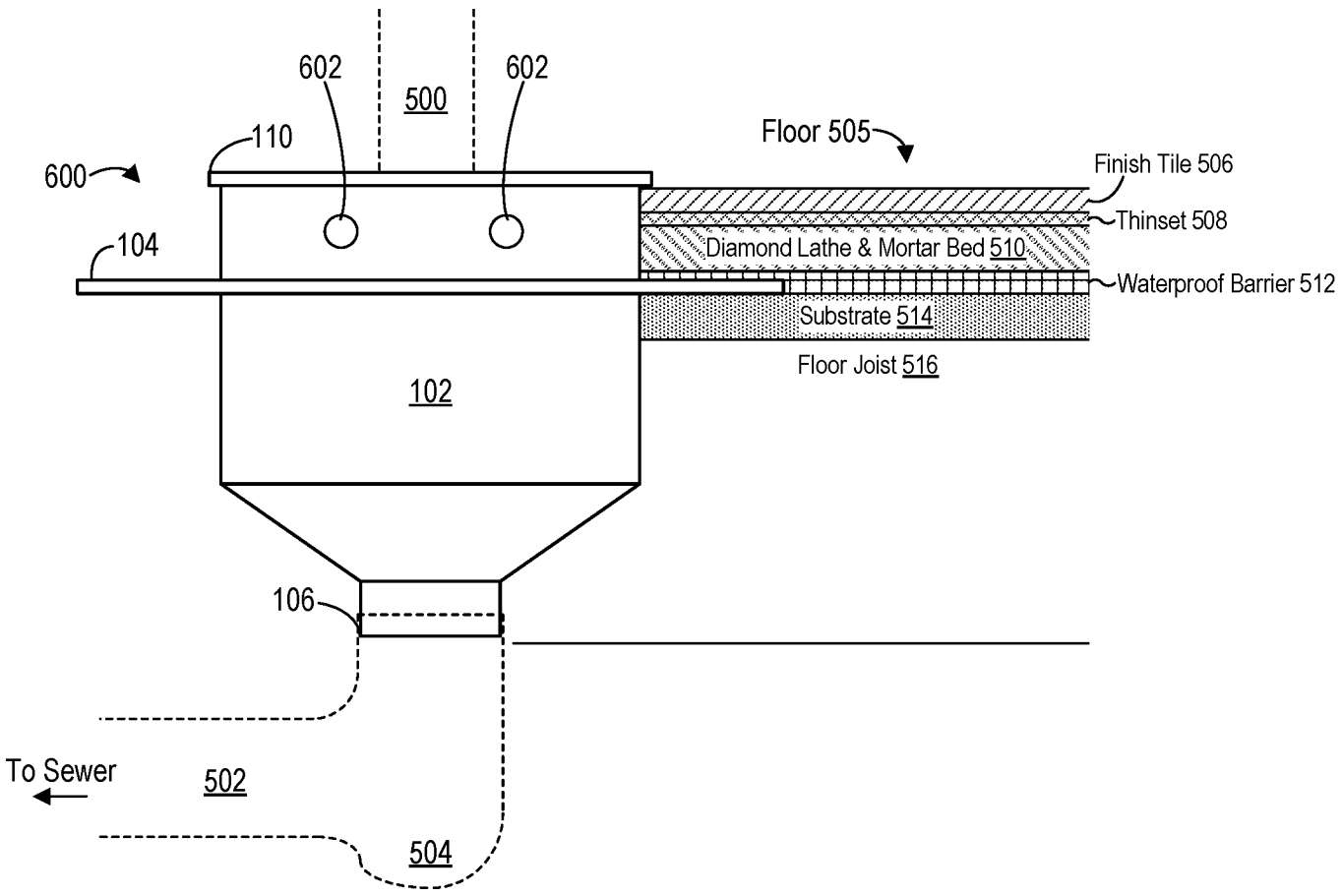
FIG. 6 shows the installation of FIG. 5 with holes in the exterior tube of the drain, in accordance with some embodiments.

In some embodiments, the exterior tube 102 of a drain 600 has holes 602, as shown in FIG. 6 in accordance with some embodiments. The drain 600 may otherwise correspond to the drain 300 (FIGS. 3 and 5) (e.g., to the drain 100, FIGS. 1A-1E). The holes 602 allow water that has penetrated into the floor 505 beneath the finish tiles 506 to drain into the exterior tube 102 from outside the exterior tube 102. The holes 602 may be in the second portion 304 (FIG. 3) of the exterior tube 102. For example, the holes 602 may be between the flange 104 and the flange 110.

Figure 7:
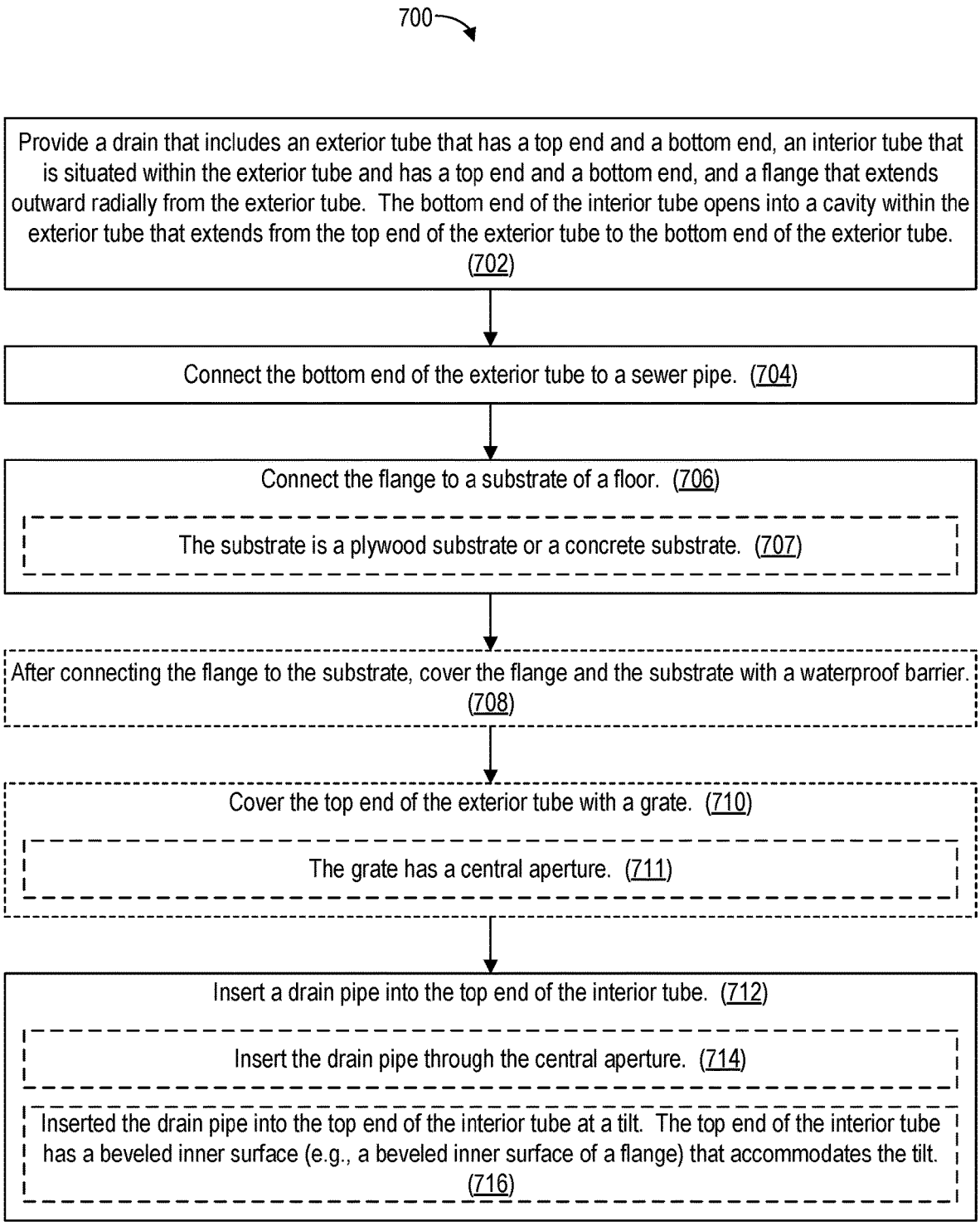
FIG. 7 is a flowchart of a drain-installation method in accordance with some embodiments.

FIG. 7 is a flowchart illustrating a drain-installation method 700 in accordance with some embodiments. In the method 700, a drain 100 (FIGS. 1A-1E) (e.g., drain 200, FIGS. 2A-2B; drain 300, FIGS. 3 and 5; drain 400; FIG. 4; drain 600, FIG. 6) is provided (702) that includes an exterior tube 102 that has a top end 108 and a bottom end 106, an interior tube 112 that is situated within the exterior tube 102 and has a top end 114 and a bottom end 122, and a flange 104 that extends outward radially from the exterior tube 102. The bottom end 122 of the interior tube 112 opens into a cavity (e.g., cavity 402, FIG. 4) within the exterior tube 102 that extends from the top end 108 of the exterior tube 102 to the bottom end 106 of the exterior tube 102.

The bottom end 106 of the exterior tube 102 is connected (704) to a sewer pipe (e.g., sewer pipe 502, FIG. 5 or 6).

The flange 104 is connected (706) to a substrate of a floor (e.g., floor 505, FIG. 5 or 6). In some embodiments, the substrate is (707) a plywood substrate or concrete substrate (e.g., substrate 514, FIG. 5 or 6). In some embodiments, after connecting the flange 104 to the substrate, the flange 104 and the substrate are covered (708) with a waterproof barrier (e.g., waterproof barrier 512, FIG. 5 or 6). Additional layers of building materials may be applied above the waterproof barrier (e.g., as shown in FIGS. 5 and 6). For example, finish tiles 506 may finish into the flange 110.

In some embodiments, the top end 108 of the exterior tube 102 is covered (710) with a grate (e.g., grate 202, FIGS. 2A-2B). The grate may have (711) a central aperture (e.g., aperture 204, FIGS. 2A-2B).

A drain pipe (e.g., for a bathtub, such as a free-standing bathtub) (e.g., drain pipe 500, FIG. 5 or 6) is inserted (712) (i.e., slotted) into the top end 114 of the interior tube 112. For example, the drain pipe is inserted (714) through the central aperture of the grate: the aperture allows the drain pipe to be inserted into the top end 114 of the interior tube 112. In some embodiments, the drain pipe is inserted (716) into the top end 114 of the interior tube 112 at a tilt. The top end 114 of the interior tube 112 may have a beveled inner surface that accommodates the tilt. For example, the top end 114 of the interior tube 112 may have a flange with a beveled inner surface that accommodates the tilt. As the drain pipe is inserted deeper into the interior tube 112, it straightens out with respect to the interior tube 112, eliminating the tilt and aligning the drain pipe with the interior tube 112.

In some embodiments of the method 700, step 712 is omitted: no drain pipe is inserted into the top end 114 of the interior tube 112. Instead, the top end 114 of the interior tube 112 may be covered with a solid piece (e.g., a disc). For example, the central aperture (e.g., aperture 204) of the grate (or a portion thereof) may be covered with the solid piece. Alternatively, the grate may be replaced with a grate that does not have a central aperture. The drain thus may be used as either a surface drain (e.g., floor drain) or a combination tub and surface drain.

Steps in the method 700 that are not order-dependent may be reordered and steps may be combined or broken out. Additional steps may be added.

The foregoing description, for purpose of explanation, has been described with reference to specific embodiments. However, the illustrative discussions above are not intended to be exhaustive or to limit the scope of the claims to the precise forms disclosed. Many modifications and variations are possible in view of the above teachings. The embodiments were chosen in order to best explain the principles underlying the claims and their practical applications, to thereby enable others skilled in the art to best use the embodiments with various modifications as are suited to the particular uses contemplated.

What is claimed is:

1. A drain, comprising:

an exterior tube having a top end and a bottom end, wherein:

the bottom end of the exterior tube is to connect to a sewer pipe, the bottom end of the exterior tube has an opening to allow wastewater to flow out the bottom end of the exterior tube into the sewer pipe, and the top end of the exterior tube has a plurality of openings to provide a floor drain;

an interior tube, situated within the exterior tube, having a top end to receive a drain pipe and a bottom end that opens into a cavity within the exterior tube that extends from the top end of the exterior tube to the bottom end of the exterior tube; and a plurality of struts extending across the cavity from the inner surface of the exterior tube to the outer surface of the interior tube to hold the interior tube within the exterior tube, the plurality of struts comprising:

a first set of struts at the top ends of the interior and exterior tubes, wherein the plurality of openings of the top end of the exterior tube are separated by the first set of struts; and a second set of struts at the bottom end of the interior tube.

2. The drain of claim 1, further comprising a flange, extending outward radially from the exterior tube, to connect to a substrate of a floor.

3. The drain of claim 1, further comprising a grate to cover the top end of the exterior tube, the grate having a central aperture to allow the interior tube to receive the drain pipe.

4. The drain of claim 3, further comprising a solid piece to cover the top end of the interior tube in the absence of the drain pipe.

5. The drain of claim 1, wherein the top end of the interior tube has a beveled inner surface to receive the drain pipe at a tilt.

6. The drain of claim 5, wherein the top end of the interior tube comprises a flange having the beveled inner surface.

7. The drain of claim 1, wherein the top end of the exterior tube comprises a flange.

8. The drain of claim 1, wherein the top end of the interior tube and the top end of the exterior tube are substantially coplanar.

9. The drain of claim 1, wherein the exterior tube comprises:

a first portion having a first outer diameter, the first portion including the bottom end of the exterior tube;

a second portion having a second outer diameter that is greater than the first outer diameter; and a third portion situated between the first and second portions and having an outer diameter that transitions smoothly from the first outer diameter to the second outer diameter.

10. The drain of claim 9, wherein:

the top end of the exterior tube comprises a first flange;

the drain further comprises a second flange, extending outward radially from the exterior tube at a position along the second portion, to connect to a substrate of a floor; and the second portion extends from the first flange at the top end of the exterior tube to the third portion.

11. The drain of claim 9, wherein the bottom end of the interior tube is situated within the second portion.

12. A drain-installation method, comprising:

providing a drain comprising:

an exterior tube having a top end and a bottom end, the bottom end having an opening, the top end having a plurality of openings;

an interior tube, situated within the exterior tube, having a top end and a bottom end, wherein the bottom end of the interior tube opens into a cavity within the exterior tube that extends from the top end of the exterior tube to the bottom end of the exterior tube; and a plurality of struts extending across the cavity from the inner surface of the exterior tube to the outer surface of the interior tube to hold the interior tube within the exterior tube, the plurality of struts comprising a first set of struts at the top ends of the interior and exterior tubes and a second set of struts at the bottom end of the interior tube, wherein the plurality of openings of the top end of the exterior tube are separated by the first set of struts; and connecting the bottom end of the exterior tube to a sewer pipe, to allow wastewater to flow out the opening of the bottom end of the exterior tube into the sewer pipe.

13. The method of claim 12, wherein:

the drain further comprises a flange extending outward radially from the exterior tube; and the method further comprises connecting the flange to a substrate of a floor.

14. The method of claim 13, further comprising, after connecting the flange to the substrate, covering the flange and the substrate with a waterproof barrier.

15. The method of claim 12, further comprising inserting a drain pipe into the top end of the interior tube.

16. The method of claim 15, further comprising covering the top end of the exterior tube with a grate having an aperture;

wherein inserting the drain pipe into the top end of the interior tube comprises inserting the drain pipe through the aperture.

17. The method of claim 15, wherein:

the top end of the interior tube has a beveled inner surface; and inserting the drain pipe into the top end of the interior tube comprises inserting the drain pipe into the top end of the interior tube at a tilt, wherein the beveled inner surface accommodates the tilt.

18. The method of claim 12, further comprising:

covering the top end of the exterior tube with a grate having an aperture to allow a drain pipe to be inserted into the top end of the interior tube; and covering the top end of the interior tube with a solid piece, in the absence of the drain pipe.

* * * * *